United States Patent [19]

Hannah

[11] 4,117,071

[45] Sep. 26, 1978

[54] CONCRETE TANKS WITH INTERLOCKING BOTTOM

[76] Inventor: James T. Hannah, 231 Main North Rd., Elizabeth Grove, South Australia 5112, Australia

[21] Appl. No.: 685,320

[22] Filed: May 11, 1976

[51] Int. Cl.[2] ..... B28B 1/16

[52] U.S. Cl. ..... 264/256; 52/247; 52/294; 249/99; 264/274

[58] Field of Search ..... 264/34, 32, 274, 256; 52/169.7, 247, 294; 249/99

[56] References Cited

U.S. PATENT DOCUMENTS

| | | | |
|---|---|---|---|
| 1,439,646 | 12/1922 | Smith | 264/274 X |
| 3,120,047 | 2/1964 | Crom | 264/34 X |

FOREIGN PATENT DOCUMENTS

| | | | |
|---|---|---|---|
| 429,725 | 10/1972 | Australia | 264/34 |

*Primary Examiner*—Thomas P. Pavelko

*Attorney, Agent, or Firm*—McNenny, Pearne, Gordon, Gail, Dickinson & Schiller

[57] ABSTRACT

The method of forming hollow concrete articles such as tanks which are cast in a mould around reinforcing metal, the mould being shaped to form a bottom and including an upstanding integral ridge which forms a mould for the inner lower portions of a wall subsequently formed on such bottom after the bottom is cast, characterized by an interlocking ridge at the join and by the absence of reinforcing metal at such join.

4 Claims, 5 Drawing Figures

CONCRETE TANKS WITH INTERLOCKING BOTTOM

Figure 1:
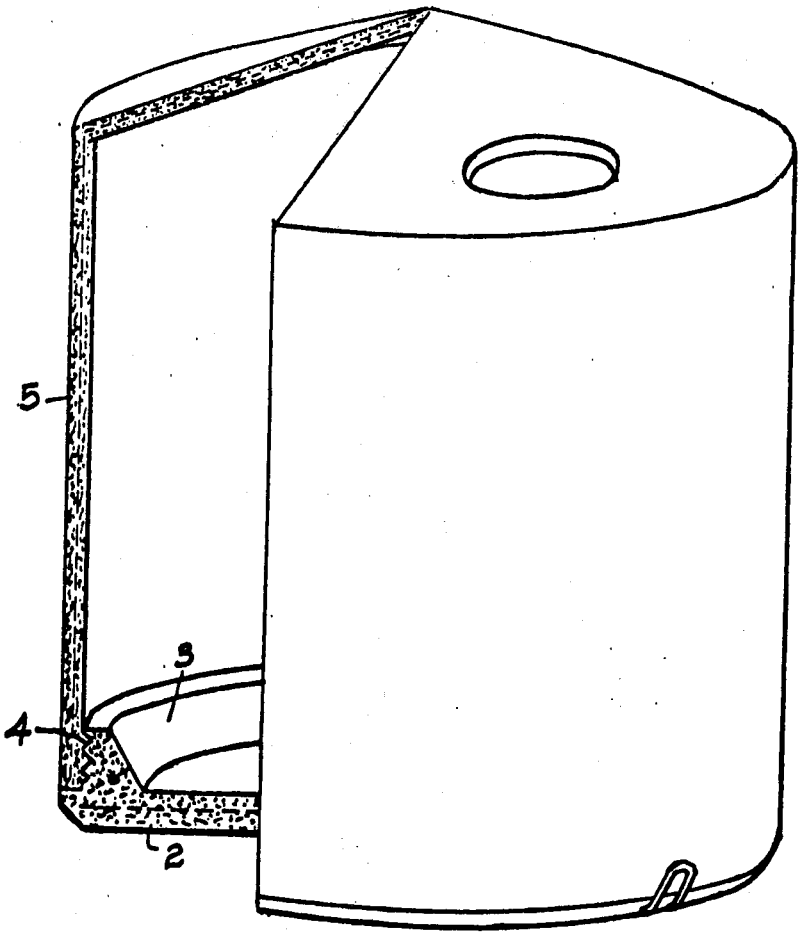

This invention relates to a method of and means for the construction of hollow articles which have a bottom or floor and a surrounding wall or walls and in particular it relates to the construction of concrete tanks in which the bottom and the walls are formed independently but interlock to form a complete unit.

According to earlier practice, the bottom of the tank was formed of concrete and included an upstanding part near its perimeter which engaged the wall of the tank which rested on the outer perimeter portion of the bottom and had its inner wall surface contiguous with the outer wall surface of the upstanding part of the bottom and locked thereto by reinforcing members which were embedded in both the bottom and the wall.

We have now found that it is advantageous not to use the reinforcing which was embedded in both the bottom and the wall for the reason that such reinforcing, which must extend through the join between the bottom and the wall, is subject to rusting and therefore can weaken the actual joint at this point.

It is well known that in reinforced concrete structures, the strength is retained provided the reinforcing does not rust. The reason for this is that rust tends to expand the original volume of the reinforcing by a factor up to seven, so that obviously if the reinforcing which extends through the joint between the wall and the bottom is subject to any leakage of water through the joint, this introduces a weak point where rusting can damage the structure.

On the other hand, we have found that if the number of annular interengaging formations on the upstanding part of the bottom against which the wall is formed; is correct it is possible to effect the necessary lock and seal, and to give the required strength, and according to our invention therefore we omit the joining reinforcement which in the past has been embedded in both the bottom and the wall and extended through the joint.

According to this invention therefore the construction of the bottom and the wall is much as heretofore, but reinforcing which previously was embedded in the bottom and extended into the wall is completely omitted.

Thus a tank according to my invention has no embedded reinforcing between the bottom and the wall, but I prefer to increase the number of interengaging formations extending around the periphery of the upstanding portion of the floor or base to give a more effective key of the wall to the base.

As an example, during pouring of the bottom, I prefer to have three angle iron rings disposed in the mould for the upstanding portion of the bottom, a heavier ring formed to say three quarter inch angle iron corresponding to the ring presently used but having a lighter ring spaced some distance above this main ring and another lighter ring spaced some distance below this main ring, the lighter rings being formed for instance of half inch angle iron. The apexes of all the rings project into the upstanding portion of the base and the edges of the rings coincide with the outer vertical face of the upstanding portion of the concrete base.

After pouring of the base these rings are removed with the mould but they leave annular depressions into which concrete of the wall is forced to form the interengaging formations.

From the foregoing it will be realized that the reinforcing for the concrete is embedded in the base and the wall and does not extend through the joint between the base and the wall. Such a structure has been found more effective and less liable to damage by rusting than the practice previously followed of having the reinforcing extend through the join between the base and wall, which was the subject of the invention previously referred to.

Figure 2:
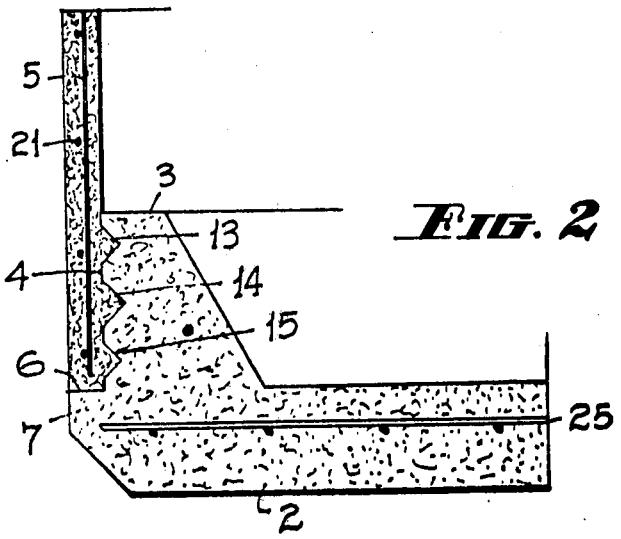
Figure 3:
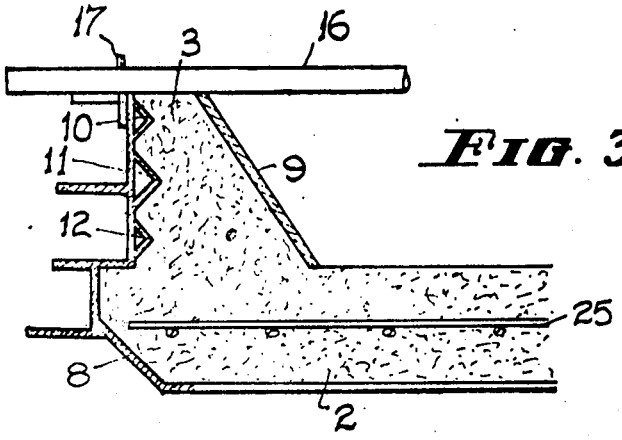
Figure 4:
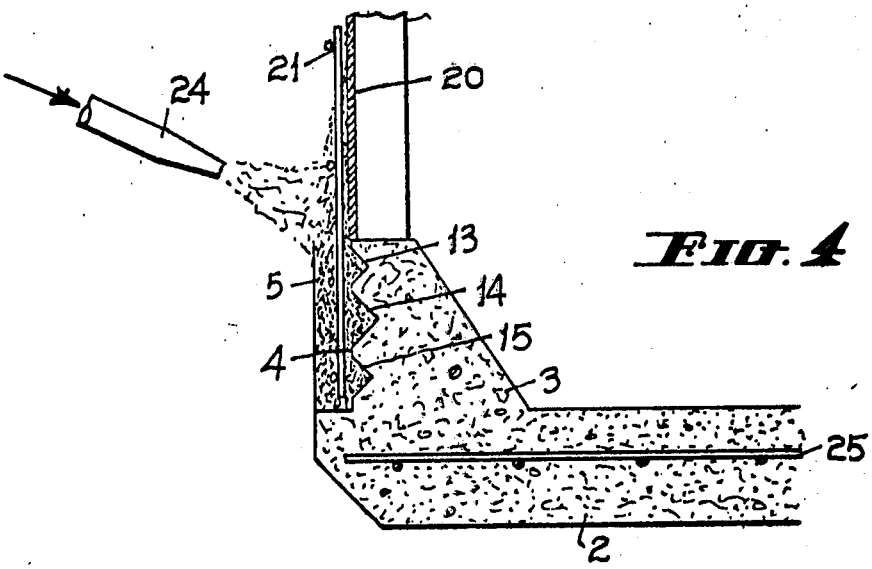
Figure 5:
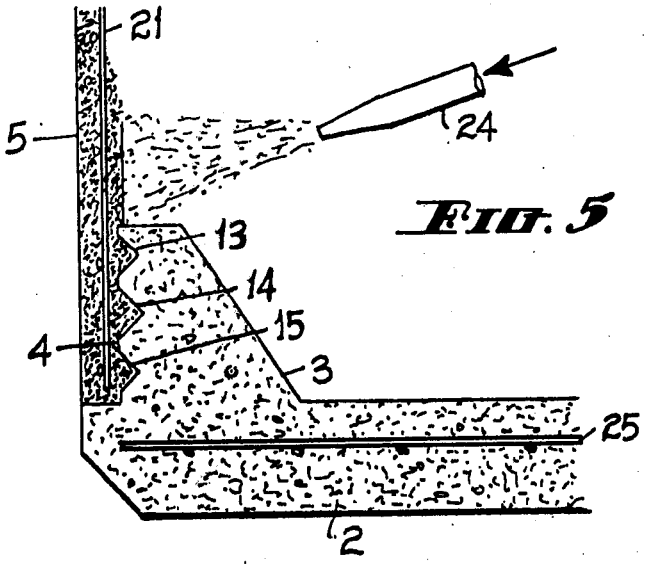

In order however that the invention may be more clearly understood, an embodiment thereof will now be described with reference to the accompanying drawings in which FIG. 1 is a perspective view, partly in section, of a typical tank, FIG. 2 is an enlarged fragmentary section of the joint, and FIGS. 3, 4 and 5 are views similar to FIG. 2 but showing the progressive steps of casting the bottom, making the seal of the wall to the bottom, and finally completing the inside of the tank.

The tank has a bottom 2 which includes an upstanding ridge 3 cast integrally with the bottom, this ridge having an outer face 4. The wall is designated 5.

A step 6 is formed between the outer face 4 of the ridge 3 and the peripheral face 7 of the bottom.

The mould 8–9 (see FIG. 3) form the bottom of the structure, the mould 8 having in it three rings 10, 11 and 12, the rings 10 and 12 being formed of half inch angle iron positioned to project the apex of the angle iron inwards from the mould part 8 to form "vee" grooves 13 and 15 in the face 4 of the ridge 3, the ring 11 being larger, preferably of three quarter inch angle iron, similarly positioned but intermediate the rings 10 and 12 to form a further "vee" groove 14. The mould 8 is formed of a series of radially defined segments which lock together during pouring.

The mould 9 forms the inner slope of the ridge 3 and is supported by spiders 16 resting on the mould 8, pins 17 on the mould 8 locating the spiders 16.

To form the wall, a mould 20 (see FIG. 4) is located on the bottom 2 after it has been poured, the mould resting on the ridge 3, and reinforcing 21 is placed into position against this mould 20 to be on the outside of the mould and extending down across the face 4 of the rdige.

Concrete slurry is now sprayed on to the mould 20 and the face 4 and into the grooves 13, 14 and 15 to build up a wall around the reinforcing 21 as shown in FIG. 4. The slurry nozzles are designated 24.

The mould 20 is then removed and the inner part of the wall 5 is built up by spraying concrete thereon until the wall has the correct thickness and the reinforcing 21 is completely covered.

Reinforcing in the bottom 2 is indicated by 25, and it will be realized that this reinforcing does not extend through the joint between the bottom 2, and also that the reinforcing 21 does not extend through the joint so that even if there should be a minute leakage through the joint, although we have found none in practice, there is no metal present corresponding to the reinforcing 12 of the earlier patent referred to which could rust and expand to cause problems at the joint.

It will be realized that the concrete forming the wall could be poured between moulds, but the method outlined is preferred as it has been shown to be highly effective.

I claim:

1. The method of forming hollow concrete articles such as tanks which comprises:

(a) providing a mould shaped to form a bottom and including on the bottom an upstanding integral ridge having a face and a laterally outward extending surface which cooperate with a wall of a concrete article to be formed to define the joint between said bottom and wall, said face forming the mould for the contiguous inner lower portions of said wall and said laterally, outward extending surface forming the mould for the lower end face of said wall, said ridge also including an interlocking sealing formation extending generally parallel to the said bottom and around the face of said upstanding ridge, said interlocking sealing formation having an upstanding dimension at least equal to about the thickness of said bottom and a majority of its upstanding extent arranged to interlock with said wall in shear, (b) pouring the said bottom, (c) removing the mould from the said bottom to expose the interlocking sealing formation and the laterally, outward extending surface of said upstanding ridge, (d) placing a mould on said bottom to form the sides of the concrete article to be formed and shaped to leave exposed the laterally, outward extending surface and the face of the said upstanding ridge having the interlocking sealing formation formed thereon, and (e) forming the said wall against said mould and face, whereby the said bottom is interlocked with said wall by only concrete-to-concrete contact and with sufficient shear to provide an interlock without any metal reinforcement extending through the said interlocking sealing formation or the joint formed between said bottom and wall.

2. The method of claim 1 in which the said interlocking sealing formation is formed by positioning a plurality of rings on the said mould whereby the bottom is formed, said rings being secured at different heights around that part of the mould which forms the outer face of said ridge.

3. The method of forming hollow concrete articles such as tanks which comprises:

(a) placing into position a mould shaped to form a circular bottom and including on the bottom an upstanding integral ridge having an outer face and a laterally outward extending surface which cooperate with a wall of a concrete article to be formed to define the joint between said bottom and wall, said face forming the mould for the contiguous inner lower portions of said wall and said laterally, outward extending surface forming the mould for the lower end face of said wall, said ridge also including an interlocking sealing formation extending generally parallel to the said bottom and around the face of said upstanding ridge, said interlocking sealing formation having an upstanding dimension at least equal to about the thickness of said bottom and a majority of its upstanding extent arranged to interlock with said wall in shear, (b) placing reinforcing into said mould, (c) pouring the said bottom by placing concrete into same, (d) removing the mould from the said bottom to expose the interlocking sealing formation and the laterally, outward extending surface of said upstanding ridge, (e) placing a cylindrical mould on said bottom to extend upwards substantially in the plane of the outer face of said upstanding ridge which has the interlocking sealing formation formed thereon, (f) placing reinforcing around said mould to extend over the said face of the said ridge and at a location spaced from said laterally, outward extending surface, (g) forming said wall by building up concrete around said reinforcing against said mould and over the face and laterally, outward extending surface of said ridge to bond the walls to said ridge, and (h) removing the said mould, whereby the said bottom is interlocked with said wall by only concrete-to-concrete contact and with sufficient shear to provide an interlock.

4. The method of claim 3 characterised by the further step of placing a layer of concrete against the inner face of said wall.

* * * * *